US006722000B1

(12) United States Patent
Weiner et al.

(10) Patent No.: US 6,722,000 B1
(45) Date of Patent: Apr. 20, 2004

(54) TIP SHEARING CARPET WITH MOISTURE CONTROL

(75) Inventors: Robert S. Weiner, Atlanta, GA (US); John W. Waller, Ringgold, GA (US)

(73) Assignee: Product Concepts Residential LLC, Dalton, GA (US)

( * ) Notice: Subject to any disclaimer, the term of this patent is extended or adjusted under 35 U.S.C. 154(b) by 0 days.

(21) Appl. No.: 10/300,464

(22) Filed: Nov. 20, 2002

(51) Int. Cl.[7] ..... D06C 23/02; D06C 13/00

(52) U.S. Cl. ..... 26/16; 26/15 R; 26/15 L; 28/160

(58) Field of Search ..... 26/15 R, 16, 15 L, 26/8 R, 9, 10 C, 8 C; 28/159, 160, 167, 162, 163, 165, 170; 83/22, 76.1, 76.4, 169, 176, 177, 331, 915, 861, 869

(56) References Cited

U.S. PATENT DOCUMENTS 1,052,934 A * 2/1913 Mallory ..... 26/15 R
1,737,085 A * 11/1929 Horstmann ..... 26/16
3,785,016 A * 1/1974 Hergert ..... 26/2 R
3,818,554 A * 6/1974 Davidson ..... 26/16
4,085,700 A * 4/1978 Engels et al. ..... 26/16
4,606,290 A * 8/1986 Marzotto ..... 26/15 R
4,649,606 A * 3/1987 Fay ..... 26/15 R
5,165,151 A * 11/1992 Nakagawa ..... 26/16
6,035,749 A * 3/2000 Haselwander ..... 83/22

* cited by examiner

*Primary Examiner*—A. Vanatta
(74) *Attorney, Agent, or Firm*—Stephen J. Stark; Miller & Martin LLP

(57) ABSTRACT

A moisture applicator is positioned to apply moisture to a pile fabric prior to the blades of a tip shearing cutter contacting the carpet so that moisture may be selectively applied for one of a number of purposes such as, but not excluding, creating a pattern, and/or providing a more uniform appearance as viewed from above in the event that the latex securing the polypropylene layer is not uniform across the width of the carpet. While moisture application may take one of a variety of forms, the preferred embodiment utilizes a steam applying moisture applicator wherein the selected portions which have moisture applied are cut to a deeper depth than the unselected portions which do not have moisture applied thereto.

18 Claims, 1 Drawing Sheet

TIP SHEARING CARPET WITH MOISTURE CONTROL

BACKGROUND OF THE INVENTION

The present invention relates to a method of finishing textile products, and more particularly, to a method of tip shearing tufted carpet utilizing moisture control.

One method of finishing tufted carpet is to tip shear the loop ends to a uniform height. U.S. Pat. No. 4,323,612, which issued in 1982, discusses carpets finished in this manner.

The traditional method of tip shearing carpets involves running tufted carpet over a roller where the roller contacts the polypropylene backing on the bottom of the carpet. The tufted loops are then cut to a uniform height utilizing a cutter having one or more blades which cuts the tufted loops to a uniform height relative to the back of the polypropylene layer on the back of a carpet since the blades of the cutter are a fixed distance from the roller. The greater a distance the tips of the pile extend from the backing, the greater amount is sheared.

The tip-shearing of carpet is utilized to provide a visual effect since the sheared ends provide a different visual effect than non-sheared ends. Furthermore, it has been discovered that the more material which is sheared away (i.e., the shorter lengths the carpet tufts are cut to extend from the backing), the darker most carpets become. Accordingly, if one area is tip sheared to a greater depth than another, the deeper cut area (and thus shorter tufts) are darker than the lighter and taller portions. When darker and lighter portions of the carpet coexist next to each other they typically result in a second quality carpet when uniformity is desired.

Even when attempting to tip shear to a uniform height, the fact that the height is normally cut relative to the back of the polypropylene layer on the back of the carpet as opposed to the lengths of tuft can create problems. Specifically, on some carpet products latex secures the secondary polypropylene to the back of the carpet. If the thickness of the latex layer changes in thickness across its width or length, then it is very likely that a second quality carpet will be produced because the height of the sheared loops will vary according to the change in thickness of the latex layer therebelow.

U.S. Pat. No. 6,035,749 discloses a method of patterned shearing of pile fabrics which effectively utilizes compressed air to provide a particular pattern when utilized in conjunction with an otherwise uniform cutting and severing apparatus. While this reference teaches an excellent way of producing patterns in pile fabrics, it requires the addition of compressed air and jets to be placed proximate to the cutter assembly. This would require retrofitting existing tip shearing cutters with compressed air capability, jets and a controller for the jets.

Accordingly, a need exists to control the tip shearing of carpet for various applications.

SUMMARY OF THE INVENTION

A need exists to be able to utilize standard tip shearing cutter equipment while providing a patterned visual effect across the top surface of the carpet having a plurality of heights as measured from the back of the polypropylene backing.

Another need exists for tip-shearing carpet to provide a uniform visual effect even when the latex and/or polypropylene layer thickness is not uniform across the width of the carpet.

Another need exists for selectively tip shearing carpet to at least two depths utilizing an otherwise uniform cutting shearing apparatus.

Another need exists to selectively apply moisture to locations on the carpet to assist in providing a desired multi-height pattern when the moistened carpet portions contact the cutting blade or blades.

Accordingly, a moisture applicator is positioned to apply moisture to a carpet prior to the blades of a tip shearing cutter contacting the carpet so that moisture may be selectively applied for one of a number of purposes such as, but not excluding, creating a pattern, or providing a more uniform appearance as viewed from above in the event that the layer(s) below the carpet are not uniform across the width of the carpet. While moisture application may take one of a variety of forms, the preferred embodiment utilizes a steam applying moisture applicator although liquid could also be applied in other embodiments, such as through liquid jets akin to an ink jet printer, or otherwise. The portions which have moisture applied are cut to a deeper depth than the portions which do not have moisture applied thereto. It is believed that the moisture on the yarn causes more friction with the blades of the shearing apparatus thereby resulting in a deeper cut being made by a normally uniform cutting blade or blades at the selected moistened portion.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
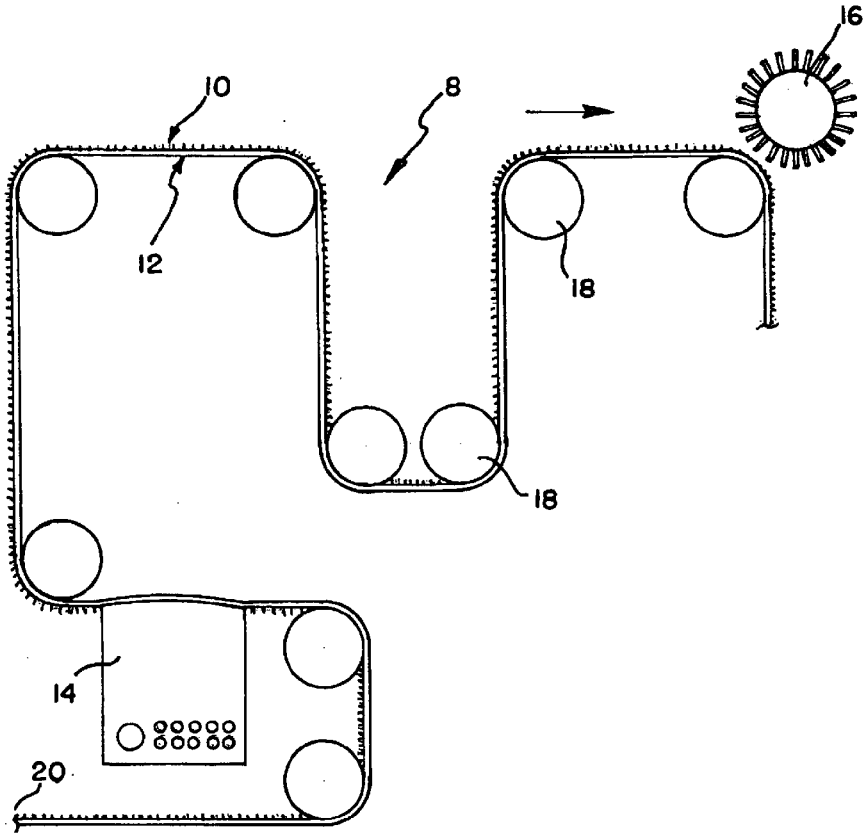
FIG. 1 shows a tip shearing apparatus in conjunction with a moisture applicator in accordance with the preferred embodiment of the present invention.

Accordingly, FIG. 1 shows portions of the pile 10 of a pile fabric 12 are moistened with a moisture applicator 14 as will be explained in more detail below prior to being cut by a shearing apparatus, or cutter 16. Rollers 18 are normally utilized to transport tufted carpet through a tip shearing mill 8 past a cutter 16.

In the prior art, manufacturers have ensured that carpet is sufficiently dry prior to beginning the tip shearing process. The applicant has observed that if the carpet has a portion that is damp, such as from dye from the dying process not completely dry, that portion is cut by the cutter 16 to a shorter height than the surrounding dryer portions. In the past, this has resulted in the creation of second quality carpet which did not provide a uniform appearance. Accordingly, carpet was stored and/or dried after dying for a period of time prior to tip shearing to ensure that it was evenly dried. The applicants are not exactly sure why the damp carpet portions are cut shorter than dry carpet portions, but assume that the damp yarn creates more friction against the blades of a cutter thereby pulling them tighter during the cutting process, and thus providing shorter length yarn extending from the backing after being cut.

After learning that moistened portions of carpet were cut shorter than surrounding drying carpet portions, the applicant obtained a moisture applicator 14 and placed it in the tip shearing mill 8 upstream of the cutter 16. Accordingly, as pile fabric 12, traditionally carpet, is provided from source 20, such as a roll, it travels continuously past moisture applicator 14 prior to being tip sheared by shearing apparatus, or cutter 16.

Figure 2:
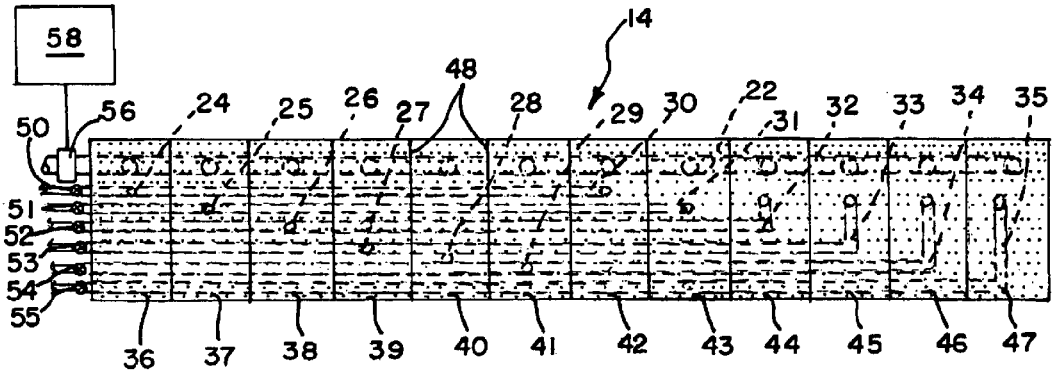
FIG. 2 shows a top view of a moisture applicator shown in FIG. 1 with internal portions shown in phantom and connected to a controller which may be utilized to selectively control moisture application from particular sections within the moisture applicator.

FIG. 2 shows a top view of the moisture applicator 14 according to the preferred embodiment. Of course, other moisture application devices such as ink jet printer type machines, or other liquid and/or steam applying devices could be utilized as well.

The moisture applicator 14 of the preferred embodiment began as a shoe hill steamer which has traditionally been utilized to at the front end of a coating mill to condition fabric so that latex may be applied during pre-bulking. The applicator 14 was then customized by combining a trunk line 22 with individual section lines 24–35. The trunk line 22 provides steam from a source to each of sections 36–47 in the applicator 14 in a substantially uniform manner. Additionally, the section lines 24–35 each feed a respective section 36–47 in the applicator 14. The sections are preferably separated by baffles 48 which allow for the passage of the lines 22, 24–35 but provide separate chambers for applying moisture to a particular location along the width of the passing fabric 12.

Valves 50–55 are illustrated in FIG. 2. A similar number would be located below these valves 50–55 which are obscured from view. Additionally valve 56 is illustrated in FIG. 2 going to the trunk line 48. A controller 58 is illustrated as able to operate the valves so that some sections 36–37 may be applying moisture while other sections are secured. Furthermore, the amount of moisture may be adjusted by the controller 58 or otherwise.

In the preferred embodiment, a supply of steam is provided to the inlets of the trunk and section lines, 22, 24–35. The controller 58 whether an operator or an automated processor, adjusts the necessary valves, such as valves 50–56 to provide the desired moisture content to the sections 36–47 in the moisture applicator 14 as the fabric 12 passes by the moisture applicator 14. When using steam, it is convenient to have the fabric 12 pass above the applicator 14, but in other embodiments, such as those having liquid applicators, it may be helpful to have the applicator above and/or otherwise positioned relative to the passing fabric 12.

The processor 58 preferably selectively applies moisture for a specific purpose. One purpose would be to tip shear a carpet which has a varying thickness of latex securing a backing to the carpet which has affected the visual appearance of tip sheared carpet since there are regions of higher and shorter yarn. The processor 58 may work in conjunction with a reader which scans the tint or color of the carpet to select which sections 36–47 should be recut. Of course, there may be more or fewer than twelve sections 36–47 in some embodiments. Another use would be to provide a pattern, or pre-set, program to the moisture applicator 14 so that a pattern having at least two heights is cut into the fabric 12 using the cutter 16 may be produced by selectively providing and securing from providing moisture at specific locations along the fabric 12. This may be useful for backed as well as unbacked carpet products. Other uses may also exist.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having set forth the nature of the invention, what is claimed is:

1. A method of shearing pile extending from backing of pile fabric to cut at least two levels of pile height, comprising:

a. providing a shearing apparatus positioned for shearing tips of pile extending from a pile fabric with at least one blade, the greater a distance that said tips extend from said backing, the greater an amount is sheared;

b. feeding said pile fabric to said shearing apparatus;

c. prior to shearing said pile fabric, selectively applying moisture to the pile fabric to moisten selected pile relative to unselected pile; and d. shearing said selected and unselected pile with said shearing apparatus in the absence of fluid forces from the step of selectively applying moisture, such that selected pile is cut to at least one different height shorter than unselected pile.

2. The method of claim 1 wherein the selective application of moisture is applied utilizing a moisture applicator.

3. The method of claim 2 wherein the pile fabric is continuously fed past the moisture applicator and then to the shearing apparatus.

4. The method of claim 1 wherein the selective application of moisture further comprises the selective application of steam.

5. The method of claim 4 wherein the selective application of steam is applied with a sectioned moisture applicator.

6. The method of claim 4 wherein a controller selectively applies steam to the pile fabric.

7. The method of claim 1 wherein the selective application of moisture to the pile fabric is performed in accordance with a pattern.

8. A method of tip shearing pile extending from a top surface of a backing of pile fabric to cut at least two levels of pile height, comprising:

a. providing a tip shearing apparatus positioned for shearing tips of pile extending from said pile fabric with at least one blade, the greater a distance that said tips extend from said backing, the greater an amount is sheared;

b. feeding said pile fabric to said shearing apparatus;

c. prior to shearing said pile fabric, selectively applying moisture to the pile fabric to moisten selected pile relative to unselected pile with a moisture applicator;

d. feeding said pile fabric a distance downstream from the moisture applicator to the shearing apparatus wherein said distance is sufficient to negate an effect of impingement forces of moisture application prior to shearing of selected and unselected pile; and e. shearing said selected and unselected pile with said shearing apparatus, such that selected pile is cut shorter than unselected pile.

9. The method of claim 8 wherein the pile fabric is fed past the moisture applicator and then the tip shearing apparatus.

10. The method of claim 9 wherein the pile fabric is continuously fed intermediate the moisture applicator and the tip shearing apparatus.

11. The method of claim 9 wherein the moisture applicator applies steam to the pile fabric.

12. The method of claim 9 wherein the pile fabric is moistened in accordance with a pattern.

13. The method of claim 12 wherein a controller provides the pattern to the moisture applicator.

14. The method of claim 9 wherein the moisture applicator is separated into sections, and said sections selectively apply moisture to the pile fabric.

15. A method of shearing pile extending from backing of pile fabric to cut at least two levels of pile height, comprising:

a. providing a shearing apparatus positioned for shearing tips of pile extending from a pile fabric with at least one blade, said at least one blade spaced a predetermined distance from a backing;

b. feeding said pile fabric to said shearing apparatus;

c. prior to shearing such pile fabric, selectively applying moisture to the pile fabric to moisten selected pile relative to unselected pile; and d. shearing said selected and unselected pile with said shearing apparatus independently of selectively applying moisture to the pile fabric, such that said selected pile is cut to a shorter height than unselected pile from said backing.

16. The method of claim 15 when the selected application of moisture is applied utilizing a moisture applicator.

17. The method of claim 16 wherein the moisture applicator selectively applies steam to the pile fabric.

18. The method of claim 15 wherein the selected application of moisture is applied in accordance with a pattern.

* * * * *